United States Patent [19]

Belbel et al.

[11] Patent Number: 4,899,119

[45] Date of Patent: Feb. 6, 1990

[54] CIRCUIT BREAKING APPARATUS WITH REMOTE CONTROLLED OPENING AND CLOSING OF ITS CIRCUITS

[75] Inventors: Elie Belbel, Epinay Sur Seine; Christian Blanchard, Nanterre; André Haury, Le Raincy; Michel Lauraire, Courbevoie, all of France

[73] Assignee: La Telemecanique Electrique, France

[21] Appl. No.: 373,654

[22] Filed: Jun. 28, 1989

Related U.S. Application Data

[63] Continuation of Ser. No. 135,518, Dec. 18, 1987, abandoned, which is a continuation of Ser. No. 798,666, Nov. 15, 1985, abandoned.

[30] Foreign Application Priority Data

Nov. 16, 1984 [FR] France ..... 8417505

[51] Int. Cl.[4] ..... H01H 75/00

[52] U.S. Cl. ..... 335/14; 335/6; 335/20

[58] Field of Search ..... 335/6, 14, 16, 20

[56] References Cited

U.S. PATENT DOCUMENTS

| | | | |
|---|---|---|---|
| 3,946,346 | 3/1976 | Oster et al. | 335/16 |
| 4,408,173 | 10/1983 | Adlerteg et al. | 335/16 |
| 4,467,298 | 8/1984 | Belbel et al. | 335/16 |
| 4,540,961 | 9/1985 | Maier | 335/16 |
| 4,598,263 | 7/1986 | Heyne et al. | 335/14 |
| 4,603,313 | 7/1986 | Shimp et al. | 335/172 |
| 4,604,596 | 8/1986 | Yokoyama et al. | 335/16 |
| 4,660,009 | 4/1987 | Wafer et al. | 335/6 |

FOREIGN PATENT DOCUMENTS

| | | |
|---|---|---|
| 45-1692 | 1/1970 | Japan . |
| 50-30061 | 3/1975 | Japan . |

*Primary Examiner*—Leo P. Picard
*Assistant Examiner*—Lincoln Donovan
*Attorney, Agent, or Firm*—William A. Drucker

[57] ABSTRACT

A circuit breaker apparatus is provided with remote controlled opening and closing of its circuits and with supports for the mobile and fixed contacts which are adapted so as to promote repulsion forces which produce a limitation of the short circuit currents, in combination with a small mass of the mobile parts, the one supporting a retractable fixed contact being associated by an extension with a slide which is moved by the remote control electromagnet.

7 Claims, 9 Drawing Sheets

FIG. 12
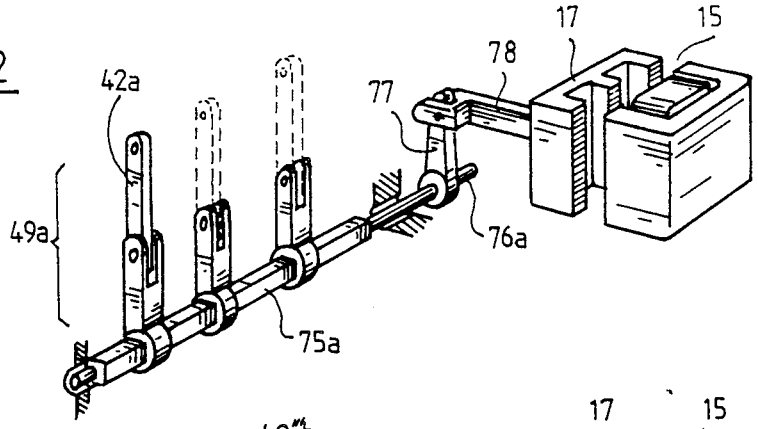
FIG. 13
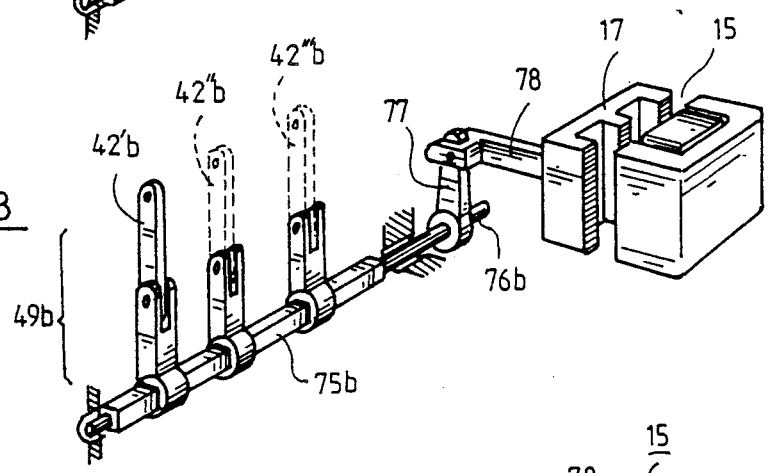
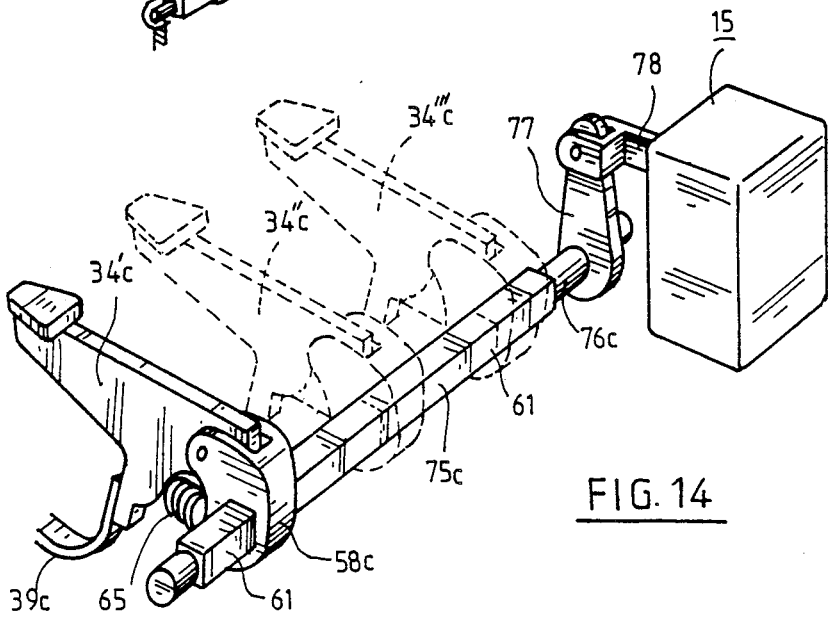
FIG. 14

CIRCUIT BREAKING APPARATUS WITH REMOTE CONTROLLED OPENING AND CLOSING OF ITS CIRCUITS

This application is a continuation, of application Ser. No. 07/135,518, filed Dec. 18, 1987, now abandoned which is a continuation of Ser. No. 798,666 filed Nov. 15, 1985, now abandoned.

BACKGROUND OF THE INVENTION

1. Field of the Invention

The invention relates to a circuit breaking apparatus, in particular a multiphase circuit breaker, comprising a common quick trip mechanism which may be set and released by means of a local manual control member, a multiplicity of power circuits each comprising between two terminals a switch whose mobile contact is connected to said mechanism so as to be closed and opened thereby, detectors which react to over currents of different kinds in these circuits by causing tripping of said mechanism and, consequently, the automatic opening of the switches and an electromagnet which is associated with aid apparatus for causing remote controlled opening of the switches not causing tripping of said mechanism.

2. Description of the Prior Art

Such apparatus are widely used in particular in complex industrial installations where it is necessary to be able to supply, isolate or re-establish groups of machines in accordance with a hierarchy and sequentially when interruptions must be or have been made for carrying out certain tests or respectively following breakdowns, adjustments or overhauls; the use of such apparatus is in particular recommended in so called selective electric installations and particularly in those which are driven by programmable sequences.

From the patent PCT No. WO 83/02680 a protection apparatus is already known having the general above mentioned construction and in which the switch is opened in the remote controlled operating mode, through movement of the mobile contact.

In this apparatus, and although the quick trip mechanism is not released at the time of this operation, a certain number of parts which form it are however moved so that frequent operation by the remote control means may cause premature wear of the parts required for resetting the mechanism and so that the power of this electromagnet must be greater than that which would be strictly necessary for opening the switch. In addition, the armature of the electromagnet serving for effecting this remote controlled opening is connected to the manual control member so that operation thereof forces the operator to exert a greater force; finally, this apparatus may be reproached because of the risk it may present for the installation to be protected since, because the manual control has priority over the remote control, it is not possible to remotely prevent an uninformed person from repeatedly attempting to re-establish a faulty line or to supply a line with power on which other persons may be occupied at work of different kinds.

The invention consequently proposes providing a circuit breaker type protection apparatus having the general above mentioned construction but in which measures will be taken for overcoming the disadvantages which have just been mentioned.

SUMMARY OF THE INVENTION

According to the invention, the aim set is reached because the fixed contact of the switch is carried by a retractable support effecting, with respect to the mobile contact, retraction and advancing movements which are caused by the changes of state of an electromagnet armature which has no connection with the quick trip mechanism.

In improvements made to the invention, an insulating transmission device will be provided between the armature of the electromagnet and the retractable support so as to make the isolation still more efficient.

According to improvements made to the invention, measures will be taken so that the pseudo-fixed contact carried by the retractable support is able to cooperate in limiting short circuit currents such a measure is particularly advantageous when the nominal rating of the apparatus exceeds that of domestic installations for which the prior circuit breaking apparatus was designed.

Finally, in constructional variants adapted for facilitating mounting so as to give to the arc chambers associated with the switch a volume compatible with their function, and to confer on the apparatus a flexibility of use answering the different needs of users, the electromagnet is disposed in a region, respectively a removable sub assembly, which does not encroach on the volumes which are usually reserved for the arc chamber, the quick trip mechanism, respectively the current detectors.

BRIEF DESCRIPTION OF THE DRAWINGS

The invention, as well as improvements thereto and variants thereof, will be better understood from reading the following description with reference to the accompanying FIGS. in which:

FIGS. 12, 13 and 14 show in partial perspective views, how pseudo-fixed contacts belonging to the power switches and an electromagnet for remote control of these switches are connected;

DESCRIPTION OF THE PREFERRED EMBODIMENTS

Figure 1:
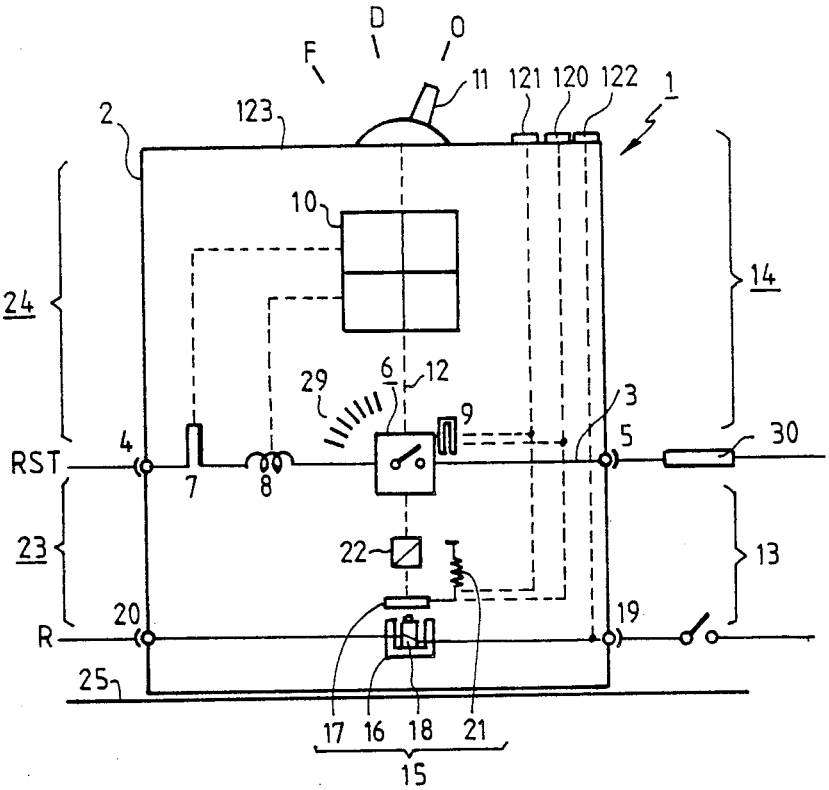
FIG. 1 shows schematically the construction of a mono or multiphase apparatus in accordance with the invention.

An electric protection apparatus 1 incorporating the invention, and which is shown schematically in FIG. 1, comprises an insulating case 2 one region 14 of which contains at least one electric power circuit 3 placed between a pair of input and output terminals 4, 5 and in series with an external load 30, a switch 6 placed in series in the circuit, detection means 7, 8, 9 reacting to over-currents of different natures which may pass through the circuit, a quick trip mechanism 10 which may be either set or released using a local manual control means 11, or be automatically tripped by certain detection means 8, 7 for example, and an actuating piece 12 of which causes closure of switch 6 for the set state and opening thereof for the released state or for the tripped state. A particular region 13 of the case comprises a remote control electromagnet 15 having, on the one hand, a magnetic circuit formed by a fixed yoke 16 and a mobile armature 17 and, on the other hand, an energization coil 18, connected to two remote control terminals 19, 20; a return spring 21 allows a rest position to be given to this armature in the absence of energization of the coil. Between the switch and said armature are disposed transmission means 22 which communicate the movements of this latter to the switch so as to cause opening or closure thereof directly or indirectly, independently of the state in which mechanism 10 is to be found it should be clear that, so as to provide the protection function of the apparatus, this electromagnet cannot cause closure of the switch when this latter has been opened by the local control or by the detection means.

The detection means 7 may comprise bimetal strips for responding either to current over intensities which are relatively small, but whose duration is excessive, or to current imbalances, whereas the detection means 8 may comprise coils equipped with strikers or conformations of the circuit which cause the attraction of cores or plates when the current over intensities are high, but are either of short duration, or limited because of the nature of the load, as is the case when an electric motor cannot start up.

Finally, detection means 9, which do not act on the mechanism, are able to respond instantaneously to excessive current over intensities which occur for example in the case of a full short circuit, for causing rapid opening of the switch; these means are frequently represented by a particular arrangement of the conductors leading to the contacts of the switch; which arrangement causes electrodynamic repulsion forces which appear when parallel conductors have flowing therethrough currents of opposite direction to be applied to said contacts; magnetizable pieces 9, which are frequently in the form of a fork between the legs of which one of the conductors at least is placed, may be associated with these means for developing the efficiency of these forces. Holding in the open state after instantaneous opening of the switch by repulsion is provided by the slightly delayed action of the magnetic means 8 which cause tripping of mechanism 10.

Such an apparatus, which is fixed for example on a support surface 25, may therefore be considered as a combination in which remote control means 23, which are essentially housed in a neighboring region 13 and whose purpose is to open circuit 3 through an independent channel, are associated with a circuit breaking type apparatus 24 which is principally located in a region 14 of the case.

This apparatus may have numerous constructional variants each having its own merits, depending on whether the construction of switch 6, the nature of the transmission and actuating means 12 or 22, the operating mode of the electromagnet 15 and, possibly, the distribution of the different parts in the case or the relative arrangement thereof with respect to the support surface is modified.

Figure 2:
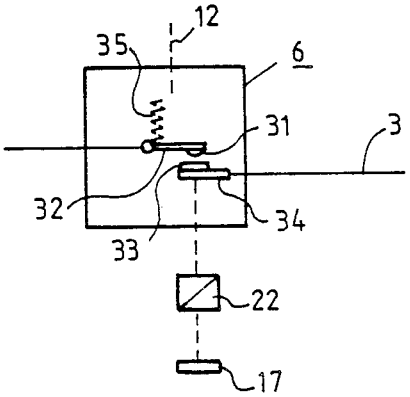
FIG. 2 illustrates schematically in greater detail one of the power switches which equip the apparatus of FIG. 1.

The different combinations which result from the above mentioned choices may also, for identical or comparable technical advantages, provide particular advantages in use which are related to the nature of the preoccupations of the user. In all cases, the apparatus may obviously comprise one or more circuits such as 3 and only have preferably a single mechanism 10 and a single electromagnet 15. In all the embodiments of the invention, switch 6 has a mobile contact 31 carried by a pivoting lever 32 on which is exerted the force of a contact pressure spring 35, and a pseudofixed contact 33, carried by a retractable support 34, a movement of the lever being caused by the movement of piece 12, whereas a second retraction of the support is caused by movement of armature 17, see FIG. 2. An arc chamber 29 equipped with fins is disposed in region 14 so as to cause the rapid extinction of the arcs.

This common arrangement may comprise pieces 12 of different kinds, and contact pressure springs 35, respectively levers 32, having different arrangements, which all allow movements by repulsion of the mobile contact before the mechanism is tripped.

Figure 3:
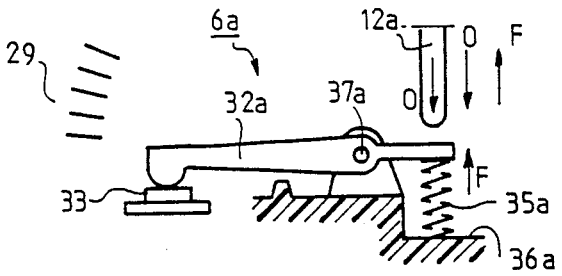
FIGS. 3, 4, 5 and 6 illustrate in a non limitative way embodiments of the mobile power switch contacts which may be used within the of the invention.

Thus, see FIG. 3, a contact lever **32*a* mounted for pivoting at 37*a* in the case, is subjected to the action of a pressure spring 35*a* which is placed between it and a support surface 36*a* of the case for ensuring closure F, piece 12*a*** then only acting on the lever so as to cause an opening movement O.

Figure 4:
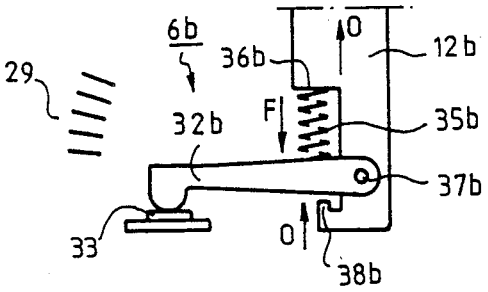

In a different arrangement, see FIG. 4, the contact lever **32*b* has a pivot 37*b* which is integral with a piece 12*b* on which the contact pressure spring 35*b* bears at 36*b* and on a stop 38*b*** of which the lever comes to rest in the open position.

Figure 5:
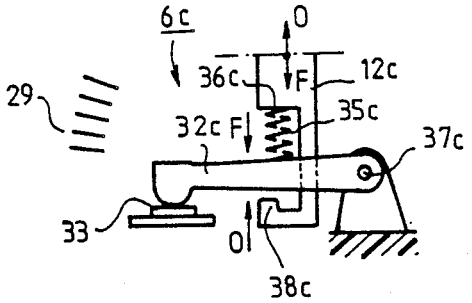

Another lever **32*c* pivoting at 37*c* in the case may also be actuated by a piece 12*c* which is equipped with the open position stop 38*c* and on which spring 35*c* bears at 36*c*, see FIGS. 5**.

Figure 6:
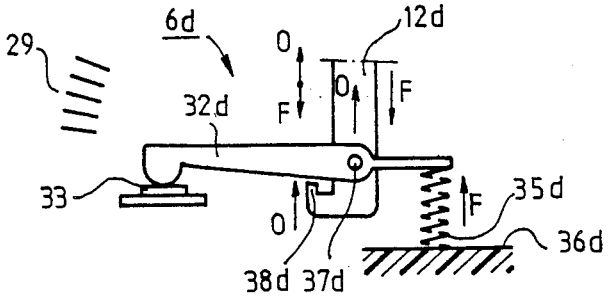

Finally, FIG. 6 shows an arrangement in which the pivot **37*d* of lever 32*d* is carried by piece 12*d* which is provided with an open position stop 38*d*, whereas the contact pressure spring 35*d* bears on the lever and on the frame at 36*d***.

In all these embodiments, the movements of pieces 12 may be rectilinear or rotary.

Figure 7:
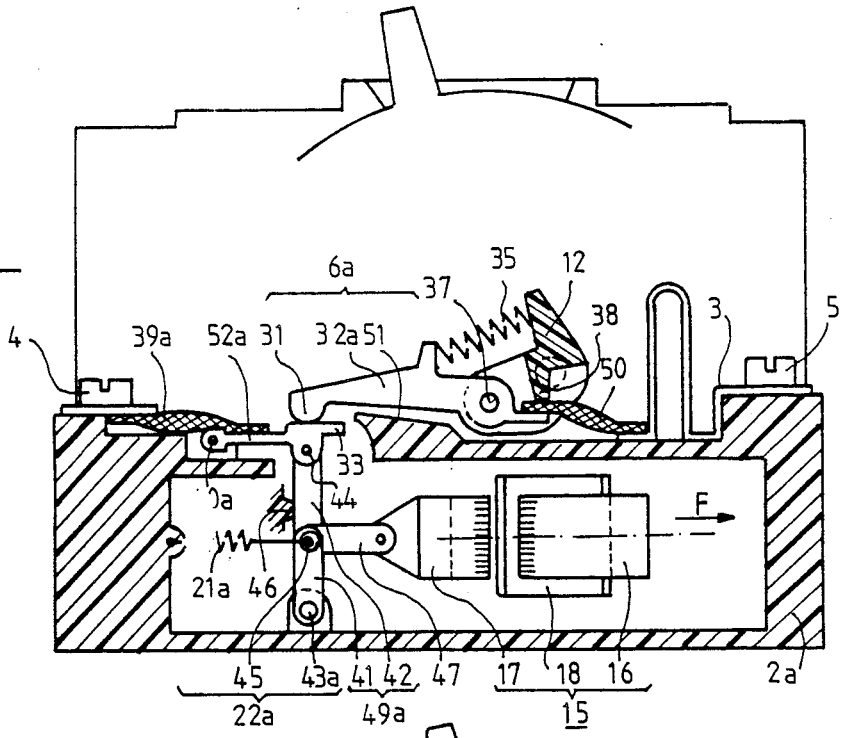
FIGS. 7, 8, 9 and 10 show in section four forms of apparatus in accordance with the invention, in the last three of which measures are taken for improving the current limiting properties.
Figure 8:
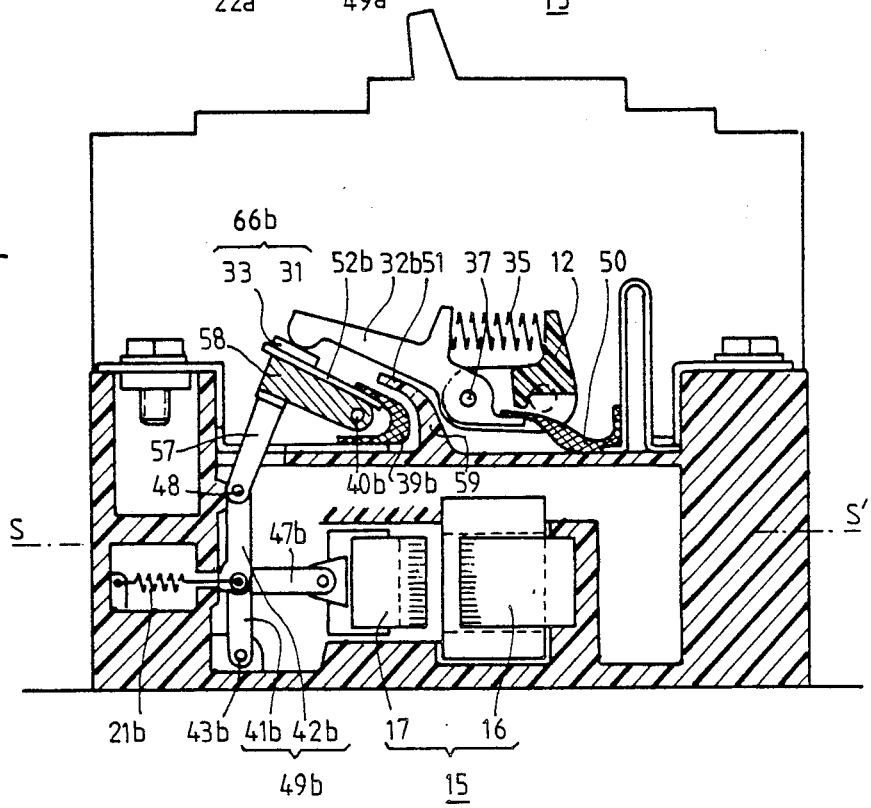
Figure 9:
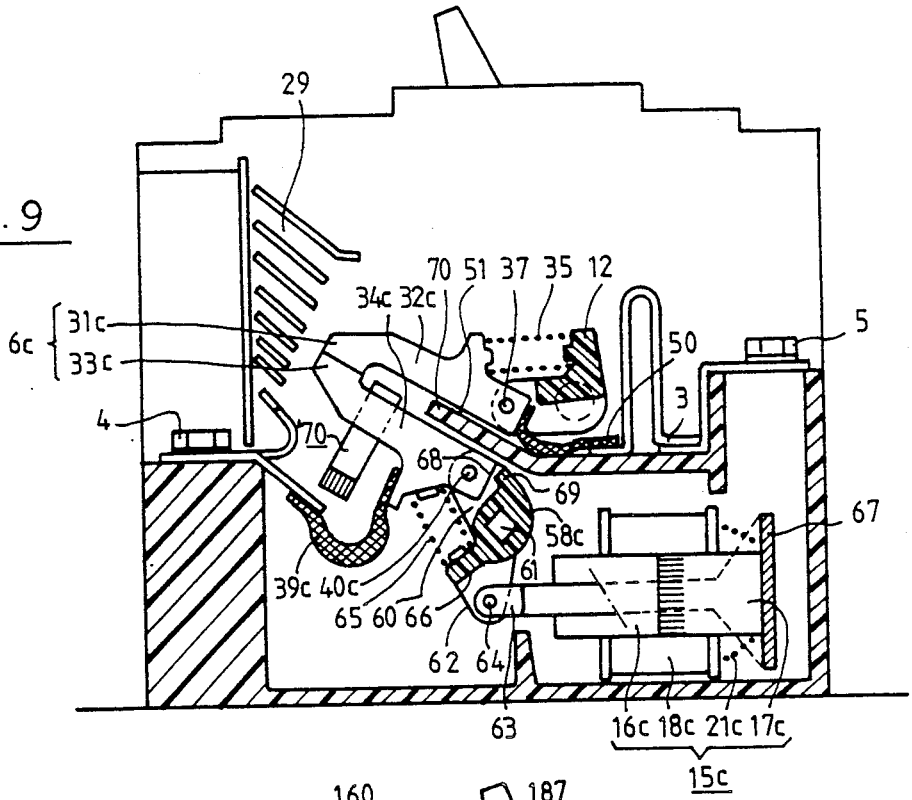

In the embodiments of the switch 6 and of the remote controlled opening device 23, shown in FIGS. 7, 8, 9, piece 12, the mobile contact lever 32 and the contact pressure spring 35 correspond to those which are illustrated in FIG. 4, the movement of piece 12 being rotary and the general arrangement of regions 13, 14 corresponding to that shown in FIG. 1; in all these subsequent embodiments, the support of the fixed contact 34 will be represented by a second conducting pivoting lever 52 which is connected to circuit 3, for example by means of a conducting braided wire, whereas the first lever 32 is connected to this circuit by a braided wire 50.

In FIG. 7, the transmission means **22*a* comprise a toggle joint 49*a* formed by the association of two links 41, 42 about a common pivot point 45, these links being connected to the case by pivot 43*a* and respectively to the lever 52*a* forming the fixed contact support by the pivot 44; the common pivot 45 is connected by a link 47 to the armature 17 of the electromagnet 15 and to a traction spring 21*a*** which may simultaneously play the role of return spring for this armature.

In the position of the armature shown in this FIG., the toggle joint is extended because of the alignment of the pivots 43, 44, 45 and bears on a stop 46 of the case so as to give to the fixed contact lever **52*a*** a fixed stable position.

When the armature changes state in direction F, towards the right hand side of the FIG. for example, because of the energization of the electromagnet 15, the preceding alignment is destroyed by the contraction of the toggle joint and the pseudo-fixed contact 33 is separated from the mobile contact 31; an effective separation is guaranteed by the presence of an abutment surface 51 of the case which prevents the mobile contact 31 from following the pseudofixed contact 33.

When the electromagnet is de-energized, the return spring 53 returns the transmission means to the position shown in FIG. 7.

In the embodiment which has just been described, the conformation of levers **32*a* and 52*a* does not promote the development of the repulsion forces whose use is however indispensable for limiting the short circuit currents which may occur in industrial installations; in addition, the direct electric connection of lever 52*a*** with the space containing the electromagnet causes serious insulating difficulties to appear.

These drawbacks are substantially reduced or eliminated in the embodiment shown in FIG. 8, where the pseudo-fixed contact support is formed by a conducting lever **52*b* which is electrically insulated from a toggle joint 49*b* by a plastic support piece 58 which may be for example pivotably mounted in the case at point 40*b*; as a variant, lever 52*b* may be directly mounted for pivoting on the insulating case if an extension 57 which connects it to the toggle joint is itself insulating; the articulation 48 common to link 42*b*** and to the extension may, if required, bear on the case.

In this embodiment, the fixed contact lever **52*b* has been placed parallel to the mobile contact lever 32*b* for developing the efficiency of the electro-dynamic forces which cause repulsion in a clockwise direction of lever 32*b***.

This parallelism is obtained more readily and without waste of space when pivots **40*b* and 37 are adjacent and when, preferably, an insulating wall 59 separates them for avoiding flash-overs; this dividing wall may advantageously play the role of stop represented by the surface 51 in FIG. 3*a*, when opening of switch 6*b*** is remote controlled.

In the two embodiments which have just been described, only the mobile contact levers are capable of repelling. The embodiment shown in FIG. 9 confers on the apparatus better short circuit current limiting properties to the extent that, as is described below, the two contact levers are each subjected to the effect of contact pressure springs.

In switch **6*c*, which the apparatus comprises, the mobile contact 32*c*, its pivot 37 fixed on the rotary piece 12, the contact pressure spring 35, the braided wire 50 and the abutment surface 51 are similar to the preceding ones. The pseudo-fixed contact lever 34*c* pivots about a pin 40*c* which is fixed to an arm 60 belonging to an insulating contact support 58*c* mounted on a pivoting shaft 61 whose section is for example square so as to be integral therewith. A second arm 62 of the support is connected by a rod 63 and an articulation 64 to an armature 17*c* of an electromagnet 15*c* having a yoke 16*c*, a coil 18*c* and a return spring 21*c***.

A second contact pressure spring 65 is disposed under compression between lever **34*c* and a bearing surface 66 of the support 58*c* so as to cause contacts 31*c*, 33*c* to be applied against each other when the armature is in the state shown in the FIG. A flexible conducting braided wire 39*c* connects the lever 34*c* to the terminal 4 of circuit 3**.

In the apparatus which has just been described, it can be seen that switch **6*c* is closed when the mobile armature 17*c* is applied against the yoke 16*c* and that, when the current is no longer supplied to coil 18*c*, the return spring 21*c* causes piece 67 which is connected to rod 63** to move rightwards.

This translational movement is communicated to the contact support **58*c* which rotates in an anticlockwise direction, causing remote controlled opening of the switch; during this angular movement, a bearing surface 68 of lever 34*c* meets an abutment 69 of support 58*c* under the effect of the second pressure spring 65**.

With this arrangement in which the two parallel contact levers **32*c*, 34*c* are mounted substantially symmetrically with respect to the plane of an insulating dividing wall 70 passing between the adjacent pivots 37, 40*c***, the two levers are capable of effecting at the same time angular movements of opposite directions when short circuit currents appear.

In this case, as in the preceding examples, these contact pressure springs must therefore have lengths and resilient properties adapted to these movements and to the exercise of the contact pressure.

The efficiency of the electrodynamic repulsion forces is improved by the arrangement of metal pieces in the vicinity of the levers; such a piece 70 which has the shape of a fork whose legs surround lever **34*c*** and whose bottom is remote therefrom is advantageously used in the embodiment which has just been described.

It should be understood that the embodiment which has just been described is not limited by the use of an electromagnet which must be de-energized for obtaining opening; instead of this type of circuit, which is advantageous for obtaining remote controlled opening when a current or a voltage disappears, a current economizing circuit may be used in which the opening, which still has an exceptional and voluntary character, of the circuit only occurs when the electromagnet is energized.

The material presentation of the apparatus of the invention must be able to comply with the different constraints with which the user is confronted.

Among these, some relate to the surface occupied by the apparatus when they are used in a very large number; others relate more particularly to the faculty of adaption of the apparatus to evolution or modification of the power supply circuits used in an industrial installation.

A construction such as shown schematically in FIG. 1 in which the electromagnet remote control device is placed in a region 13 between a fixing surface 25 and a second region 14 reserved for a circuit breaking device lends itself well to a reduction of the fixing surface which allows a large density of apparatuses to be obtained on a limited surface.

Figure 11:
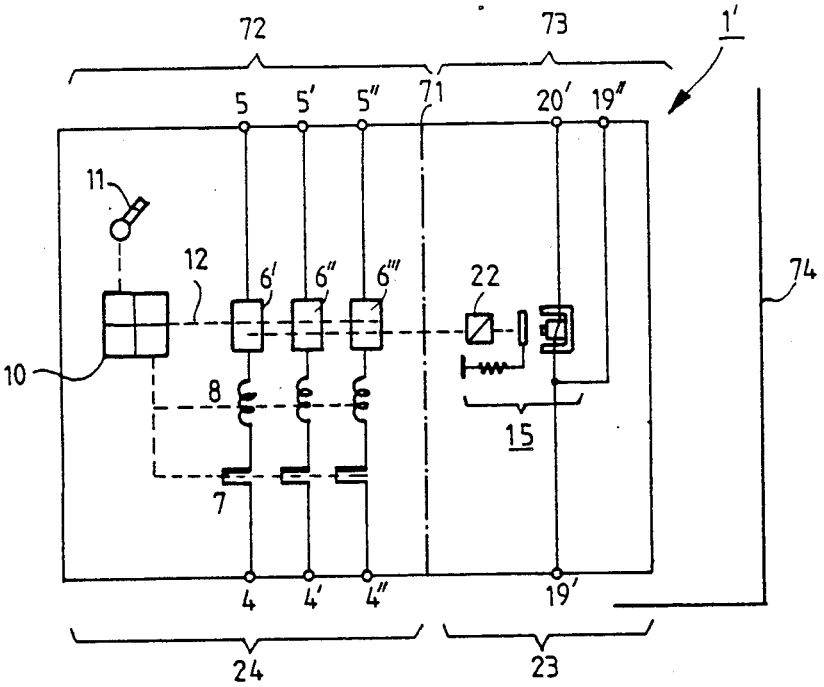
FIG. 11 shows schematically how the regions reserved for the circuit breaking function and respectively for the remote controlled opening function may be disposed in an apparatus of the invention.

If the surface available is greater, and if the user desires distinct separation of the function and connection and fault finding facilities, a presentation of the apparatus 1' such as shown in FIG. 11 may be preferred to the preceding one in which the case 71 has two adjacent lateral regions 72 and 73 both abutting against the support surface 74; these regions are intended, one for receiving means providing the automatic circuit breaking function 24 and the other for receiving remote controlled opening and closing means 23. In this FIG., the members having the same function as in FIG. 1 bear identical references or references provided with an index.

FIGS. 12, 13, 14 show how control shafts 75*a*, respectively 75*b*, respectively 75*c* mounted for pivoting in the case and of polygonal section, which extend parallel to the fixing surface for securing the pivots 43*a*, respectively 43*b*, respectively 61 of FIGS. 7, 8, 9 in angular relation may be connected by one of their ends 76*a*, 76*b*, 76*c* to a lever 77 associated with the armature 17 of the electromagnet 15 by a rod 78; these shafts are obviously secured to toggle joints 49 or contact supports 58*c* which are associated individually with each of the switches such as 6', 6'', 6''' of a multiphase apparatus. In the case of FIG. 12, insulating links 42*a* are for example provided in the toggle joints 49*a* for providing galvanic separation of the different fixed contacts of the apparatus.

As was explained above, the electromagnet 15 may cause the remote controlled opening of the switch either in its energized state or in its de-energized state.

It is also possible, with a view to saving current, to use a remote control electromagnet associated with a mechanical accessory catch device 92 for giving to the switch each of its two stable remote controlled states when the coil receives successive current pulses.

Figure 15:
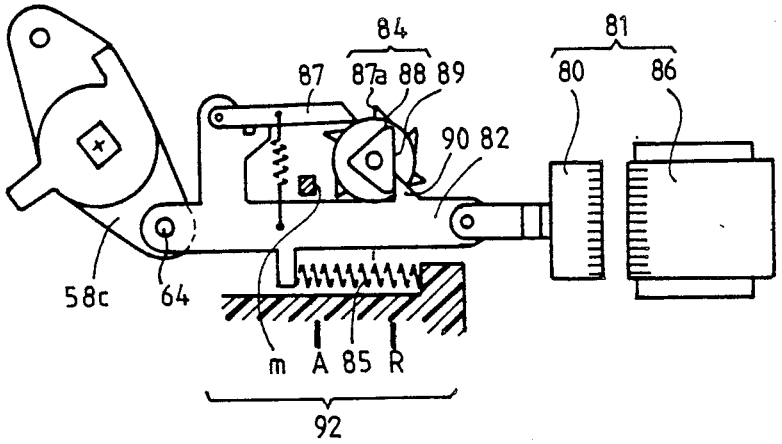
FIG. 15 illustrates a particular embodiment of the connection means which connect the pseudo-fixed contact or contacts of one or more power switches to a remote control electromagnet which operates by means of current pulses.

The principle of such a mechanism is illustrated in a non limitative way in FIG. 15; where the armature 80 of this electromagnet 81 is hitched for example to the pivot 64 of a contact support such as 58*c* by means of a slide 82, cooperating with a rotary holding latch 84.

A spring 85 tends to move slide 82 and armature 80 leftwards of the FIG. and when the armature is not attracted by the yoke 86 a nose piece 90 of this slide rests either on one of the bosses 88 of a cam 89 integral with the latch or against a fixed stop m of the case; when the armature is attracted and drives the slide, a pawl 87 integral therewith meshes with a tooth 87*a* and causes rotation of latch 84 over a fraction of a revolution; such rotations move the boss away from the rectilinear path over which the nose piece travels or, on the contrary, brings it back onto this path.

Whenever the electromagnet is energized for a short period, then de-energized, a change of position of the slide is therefore provided and so a modification of the state of the switch.

Figure 16:
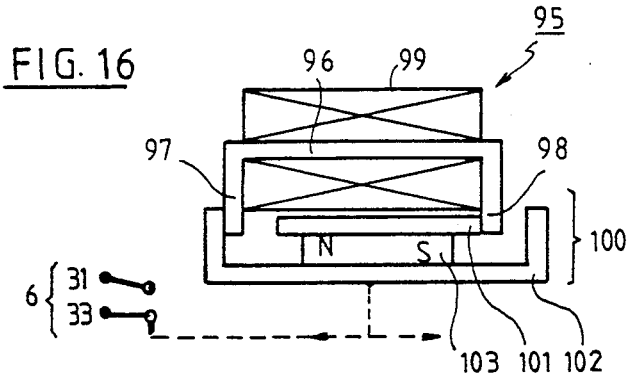
FIG. 16 shows in a simplified way the members of a biased electromagnet which may be associated with the power switch remote control.

Another way of causing the change of state of the switch by means of the current pulses consists in using a bistable electromagnet 95 such as the one shown by way of example in FIG. 16.

This electromagnet has a fixed yoke 96 in the form of U, which is energized by the coil 99 and whose parallel legs 97, 98 cooperate alternately with the opposite pole pieces 101, 102 of a mobile armature 100, which is biased by a permanent magnet 103 and which is connected to a control piece of the pseudo-fixed contact of switch 6 by means shown with a broken line.

An apparatus of the invention may advantageously be formed by associating two separable sub assemblies, one fulfilling the function of circuit breaker and the other that of the remote control device.

Such a division is advantageous to the extent that on the one hand it avoids handling a relatively heavy apparatus during assembly, as would be involved in the opposite case and, on the other hand, allows checks and adjustments to be made on parallel manufacturing lines.

In addition, with this division, the user need only change the sub-assembly which has become defective. Finally, such a measure allows the user to be able subsequently to add remote controlled opening means to a circuit breaking apparatus, if that becomes necessary, without it being necessary to interrupt a supply line for incorporating therein a remote controlled isolating switch.

Figure 17:
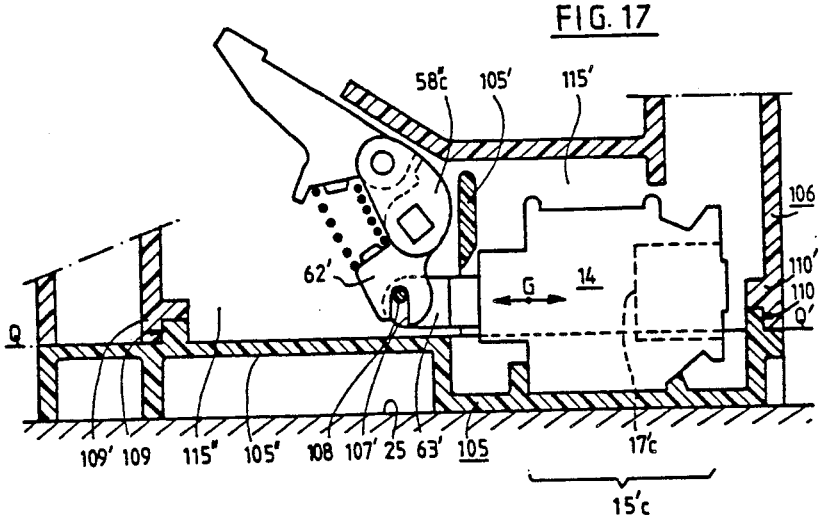
FIGS. 17 and 18 show, in two partial sections, an apparatus in accordance with the invention of FIG. 9 in which a cover may be substituted for a remote control electromagnet disposed in a removable base so as to form a traditional circuit breaker.
Figure 18:
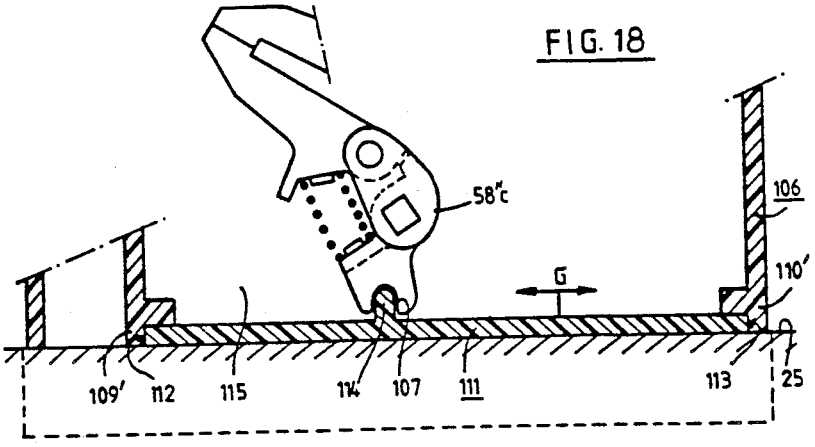

In FIGS. 17 and 18 a remote controlled opening circuit breaking device has been shown, by way of example, whose construction corresponds substantially to that shown in FIG. 9, but in which the electromagnet 15'*c* and its connecting terminals not shown are disposed in an insulating base 105 which may be—see FIG. 17—associated with or dissociated from a body 106 containing the circuit breaker.

The arm 62' of the contact support 58''*c* does not comprise any articulation, but has means for removable pivotable coupling with rod 63' of armature 17'*c*.

These means are shown here, in a non limitative way, by a groove 107 of arm 62'*c* whose direction is substantially perpendicular to the fixing plane QQ' of the base, and by a pin 108 disposed at the end of the rod; this direction corresponds substantially to that of the relative movement for assembling and disassembling the base.

So that cooperation between the groove and the pin is established in a suitable position, cooperating surfaces between the association faces of the base and of the body such as 109 and 110, 109' and 110' provided.

When no remote control device is required, see FIG. 18, the base is replaced by a cover 111 which has, on the one hand, shaped surfaces 112, 113 cooperating with those 109', 110' of the body and, on the other hand, a means for immobilizing the fixed contact support in the closure position such as a rib 114 which engages in groove 107 for preventing movements in direction G of the support 58''*c*; FIG. 17 also shows that the body and the base may have walls 105', 105'', which are adapted for improving the isolation between the contacts and the electromagnet, by creating together a chamber 115' for this latter and a chamber 115'' for the fixed elements of the switch. With the cover 111, body 106 defines, in FIG. 18, a sealed chamber 115.

Figure 19:
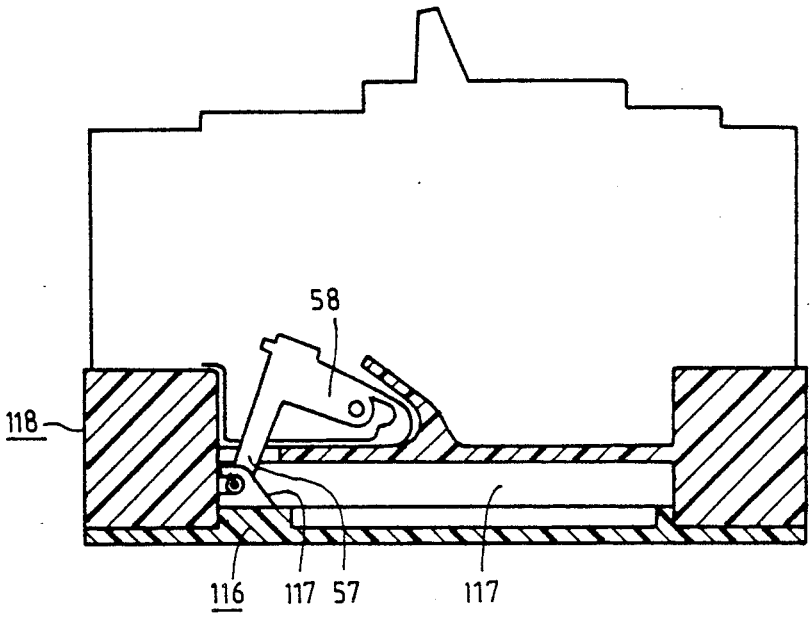
FIG. 19 shows, in a partial section, an apparatus according to the invention of FIG. 8, in which a removable remote control electromagnet is replaced by a cover so as to form a traditional circuit breaker.

Another remote controlled opening circuit breaker apparatus whose construction corresponds substantially to that of FIG. 8, and which is formed by the association of two separable sub-assemblies having the same functions as before, is shown in FIG. 19 where the body 118 of the circuit breaker is shown without the remote control subassembly.

A cover 116, which is associated with the body for closing the volume portion 117 in which the electromagnet 15*b* is at least partially placed, further has a fixed holding means 117 with which the end of the extension 57 of the fixed contact holder 58 cooperates so that this latter is immobilized.

As for all switch protection apparatus, it is necessary for the user to be informed of the open or closed state of the remote controlled opening circuit breaker.

Electrical 122, optical 120 or mechanical 121 signalling means must therefore essentially show on the front face 123 of the case 2, see FIG. 1, the state in which the pseudo-fixed contact 33 is situated; the control member 11 of the circuit breaker generally assumes a particular position when the opening results from the appearance of a defect in the line or in the load.

Figure 20:
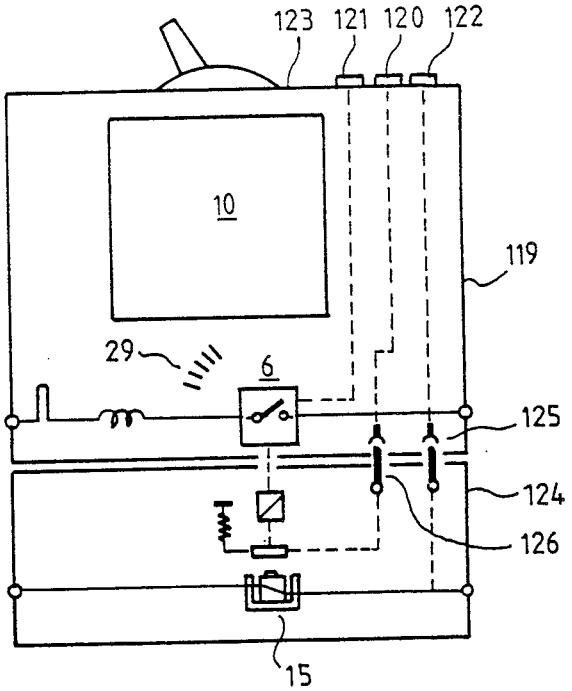
FIG. 20 shows schematically, on the one hand, how the regions intended for the circuit breaking and, respectively, remote controlled opening functions may be disposed in an apparatus of the invention according to FIGS. 7, 8, 9 and 10 and, on the other hand, how signalling required for the user may be provided.

If the remote control electromagnet is of a conventional type, in which the current should be maintained in the coil so that the armature keeps its position, a signalling lamp may be placed in parallel across this coil. In the other cases, a mechanical means is required for transmitting at least partially information concerning the state or the position of the pseudo-fixed contact. It is clear that, if the apparatus is formed by a separable case 119 and base 124, these mechanical, electrical or optical transmission means will have to transfer the information to the front face by means of removable mechanical, electrical or optical coupling means, shown schematically by 125, 126 in FIG. 20 where, in a non limitative way, an apparatus is shown having a superimposed case and base.

Figure 21:
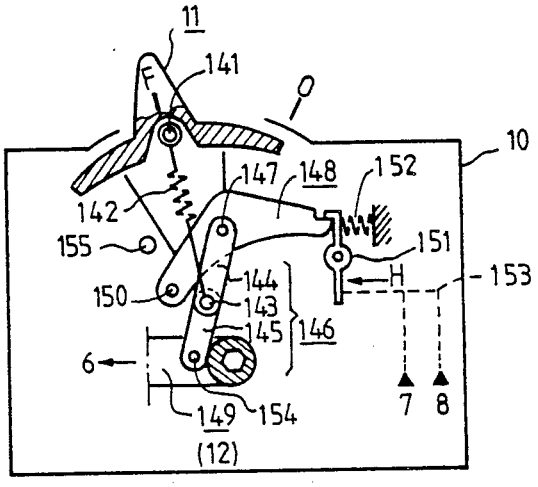
FIG. 21 shows a non limitative example of a construction of a quick trip mechanism adapted to the manual and automatic control of a circuit breaker.

By way of illustration there is shown in FIG. 21 a general diagram of a quick trip mechanism 10 which may be used within the scope of the invention.

The local manual control member 11 swings about a pivot, which is masked in the FIG., so as to move a point 141 between positions 0 and F, corresponding to manual opening and closing of the switch.

This point 141 is connected by a traction spring 142 to the pivot 143 common to two links 144, 145 which form a toggle joint 146 and one of which bears on the point 147 of a tripping lever 148, whereas the other is connected by a pivot 154 to a transmission lever 149, representing for example the mobile contact support 12 of the preceding FIGS., so as to impart a movement thereto. The tripping lever 148 which is mounted for pivoting at point 150 is retained by a latch 151 whose holding position is defined by a spring 152; this latch may be moved in direction H by a transmission means 153 receiving directly or indirectly the movements of bimetal strips 7 or those of the magnetic coil plates or cores 8.

When the switch is to be opened manually, moving the control member 11 to 0 places the point 141 in a position in which the force of spring 142 may first of all move pivot 143 laterally then cause rapidly the contraction of the toggle joint, so that the transmission lever 149 is moved upwardly in the FIG.; reverse movements are effected when the control lever pivots from 0 to F.

If the over current detection means 7, 8 move the latch 151, by compressing the spring 152, the tripping lever 148 loses its bearing point and rocks upwardly in the FIG. bringing point 147 suddenly into a position in which the angle formed by points 147, 143, 154 changes direction, so that the force of the spring 142 is exerted now with a lateral component which also causes the toggle joint to contract very rapidly and so causes the transmission lever to pivot automatically as before; a stop 155 serves for defining the limit position of the tripping lever 148.

In the whole of the variants of apparatus which have been described, it can be seen that the regions in which the electromagnets are placed for controlling the opening do not encroach on the regions which are reserved for the quick trip mechanism and respectively for the arc chamber 29 required for their extinction; with this measure, the correct operation thereof is not compromised and a good isolation is kept.

Figure 10:
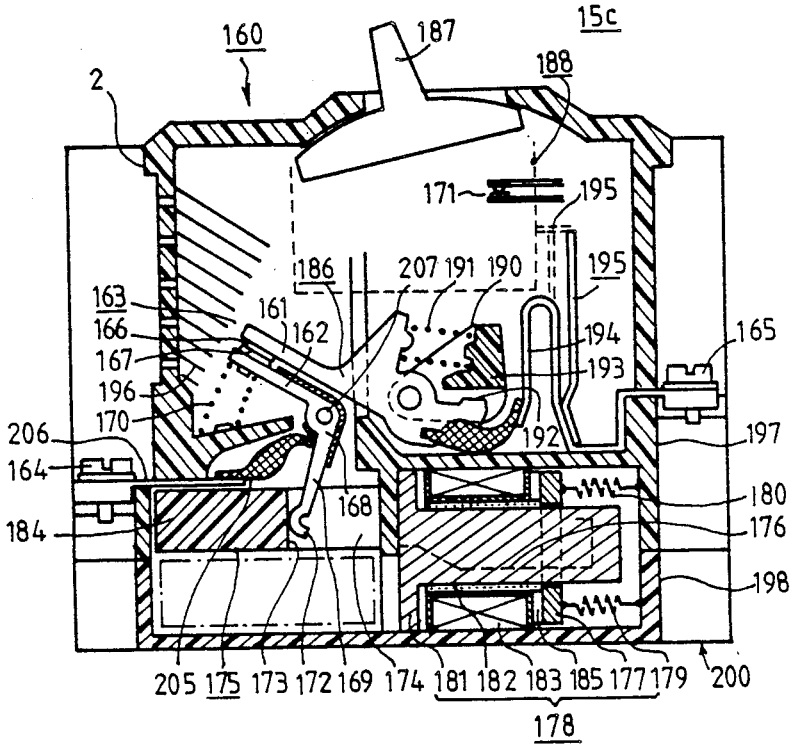

In another example of construction of the apparatus 160, shown in FIG. 10, the contact supports 161, 162 of the switch 163, serving a line passing between terminals 164, 165, are each provided in the form of a flat piece parallel to the other which, through using contact inserts 166, 167 which are also flat, allows the current lines extending through these supports to be brought together so as to increase the efficiency of the repulsion forces appearing during a short circuit.

The pivoting pseudo-fixed contact lever 168 is here provided with an extension 169 and it is subjected to the action of return spring 170 placed in the breaking chamber under support 162. The end 172 of the extension is applied under the effect of the spring against a bearing surface 173 of a window 174 belonging to an isolating rake, or remains in the vicinity of this bearing surface if other means retain the lever 168. The isolating and sliding rake 175 is connected by lateral extensions 176 (shown with dotted lines) to an armature 177 of an electromagnet 178. It is clear that this rake may be considered as a pusher or slider depending on whether the electromagnet is placed at the left or right of end 172.

This armature, which may be returned to the rest position by springs such as 179, 180 is attracted in a movement parallel to the base 200 by a yoke 181 coupled to a core 182 about which the energization coil 183 is placed.

In the remote controlled closed state of the switch, which is illustrated here, the armature is attracted by lateral legs 185 of the yoke and the rake 175 (which has moreover as many legs 184 as there are lines or phases to be controlled) is placed in the position shown in this FIG., the coil being supplied with a holding current.

When a remote controlled opening is to be operated, the coil is no longer supplied with power and, with the rake accompanying the armature in its rightward movement which is caused by springs 179, 180, the pseudo-fixed contact lever 168 is separated from the mobile contact lever 186 by the thrust action of surface 173 on end 172. The dimensions of the window 174 allow lever 168 to effect alone and freely the repellent movement when the electromagnet is energized.

For forcibly releasing the attraction of the electromagnet 178 when the circuit breaking device has been tripped, for example for preventing an ill considered operation of handle 187 after a short circuit from causing reclosure of switch 163 in a defective line, an auxiliary switch 171 may be used which is placed in series with the coil and which, for example, is actuated by mechanism 188 for preventing closure of the circuit of the coil.

When manual opening of the switches is performed, the movement of handle 187 is transmitted from the mechanism 188 to a pivoting insulating support 190 on which are placed the mobile contacts which then swing in a clockwise direction, driving the mobile contacts with them; the expansion travel of the contact pressure spring 191 is then limited by the cooperation of surfaces 192, 193. When automatic opening results from the appearance of excessive currents detected either by the magnetic loop 194, or by the bimetal strip 195, tripping of the mechanism 188 is effected by a release means 195 and the insulating support 190 pivots as in the preceding case. The appearance of a full short circuit current through the switch, which does not allow the magnetic loop and the bimetal strip to react quickly enough, causes the rapid repulsive separation of the contact levers 168, 186, which, in cooperation with lengthening and splitting up of the arc on fins 196, allows limitation of the short circuit currents to be obtained.

The separation of the pseudo-fixed contact 168 is made possible because of the length of opening 174; during this separation, the lever 168 drives no other part with it, so that the mass of the moving parts is reduced and the speed of opening is therefore improved. The braided wire or other flexible conductor 205 which electrically connects the lever to circuit 206, is, for the same reasons, advantageously connected to the vicinity of the pivot 207 of lever 168, so that arm 169 does not conduct the current.

As in an embodiment already described above, the apparatus may comprise a main body 197 containing the means required for accomplishing the circuit breaking function and an auxiliary case 198 which is associated with the preceding one and contains the means required for carrying out the remote controlled opening and closing function.

The embodiments of the fixed retractable contacts illustrated in FIGS. 9 and 10 are directly related to the possible embodiments of the mobile contacts which are illustrated in FIGS. 4, respectively 3; it should be clear that other embodiments of fixed retractable contacts, for example those whose principles are illustrated more particularly in FIGS. 5, 6, could also be used.

What is claimed is:

1. A circuit breaking apparatus, in particular a multiphase circuit breaker comprising:

i- a common quick trip mechanism which may be set and released by means of a local manual control member, ii- at least a power circuit comprising between two terminals a switching having a first mobile contact connected to the mechanism so as to be actuated thereby between closed and opened positions, and a second mobile contact carried by a first pivoting lever so as to effect with respect to the first mobile contact, retracting or advancing movements between at least a retracted position, wherein the second mobile contact is spaced from the first mobile contact, and an advanced position, wherein the second mobile contact bears on the first mobile contact with the said first mobile contact is in its closed position, iii- detectors which react to overcurrent passing through said power circuit by causing the tripping of said mechanism and consequently the automatic opening of the switch, and iv- an electromagnet which is associated with the apparatus for causing remote controlled opening of the switch not causing the tripping of said mechanism, said electromagnet having an armature which is connected to said first pivoting lever through transmission means including an insulating pivoting support pivoted about a fixed axis and having a first arm on which is pivoted the said first pivoting lever and a second arm which is connected to the armature through articulation means, and a spring disposed under compression between the first pivoting lever and a bearing surface of the insulating pivoting support.

2. The circuit breaker (apparatus) as claimed in claim 1, wherein said (fixed contact) first pivoting lever and said transmission spring are carried by said insulating support.

3. The circuit breaker apparatus as claimed in claim 1, wherein said (fixed contact support) first mobile contact (extends parallel to said mobile contact support) is carried by a second pivoting lever and said first and said second pivoting levers have two respective portions which extend parallel to each other so as to promote the development of repulsion forces acting in a direction of separation of the contacts.

4. The circuit breaker apparatus as claimed in claim 1, wherein said transmission spring (respectively said return spring have) has an elasticity allowing said first pivoting lever (fixed contact lever) to travel a considerable distance when repulsion forces appear.

5. A circuit breaking apparatus, in particular a multiphase circuit breaker comprising:

i- a common quick trip mechanism which may be set and released by means of a local manual control member, ii- at least a power circuit comprising between two terminals a switch having a first mobile contact connected to the mechanism so as to be actuated thereby between a closed and an opened positions, and a second mobile contact carried by a first pivoting lever so as to effect with respect to the first mobile contact, retracting or advancing movements between at least a retracted position, wherein the second mobile contact is spaced from the first mobile contact, and an advanced position, wherein the second mobile contact bears on the first mobile contact when said first mobile contact is in its closed position, said first pivoting lever being provided with an extension, iii- detectors which react to overcurrent passing through said power circuit by causing the tripping of said mechanism and consequently the automatic opening of the switch, iv- an electromagnet which is associated with the apparatus for causing remote controlled opening of the switch not causing the tripping of said mechanism, said electromagnet having an armature, and being controlled by current impulses each causing a brief outgoing and return movement of the armature, v- a transmitting member having abutment means, a first end portion hinged to said extension and a second end portion coupled to said armature, said transmitting member being movable between a first position which corresponds to the advanced position of the second mobile contact, and a second position which corresponds to the retracted position of the second mobile contact, vi- spring means acting on said transmitting member to put it in its first position, and vii- a locking device having locking means which present a locking state, wherein it cooperates with said abutment means so as to lock said transmitting member in its second position and an unlocking state, wherein said transmitting member which is unlocked and is subjected to the action of said spring means, passes into its first position, said locking device having control means causing said locking means to pass from one of said states to the other in response to each current impulse applied to the electromagnet.

6. A circuit breaking apparatus, in particular a multiphase circuit breaker comprising:

i- a case provided with a first association face having an opening and first cooperating surfaces, said case comprising:

a common quick trip mechanism which may be set and released by means of a local manual control member.

at least a power circuit comprising between two terminals a switch having a first mobile contact connected to the mechanism so as to be actuated thereby between a closed and an opened positions, and a second mobile contact carried by a first pivoting lever so as to effect with respect to the first mobile contact, retracting or advancing movements between at least a retracted position, wherein the second mobile contact is spaced from the first mobile contact, and an advanced position, wherein the second mobile contact bears on the first mobile contact when said first mobile contact is in its closed position, detectors which react to overcurrent passing through said power circuit by causing the tripping of said mechanism and consequently the automatic opening of the switch, ii- a separable remote control box having a second association face and second cooperating surfaces shaped so as to cooperate with said first cooperating surfaces for removably fixing said box on said case, said box including an electromagnet which is adapted for causing remote controlled opening of the switch not causing the tripping of said mechanism, said electromagnet having an armature which serves to actuate said first pivoting lever by means of removable coupling means having a coupling element connected to the armature and passing through said opening to be in a cooperating relation with said first pivoting lever when said box is fixed to said case, iii- a removable cover adapted to be removably fixed on said first association face, when said box is disconnected from said case, said cover having means for locking against rotation said first pivoting lever in a position which corresponds to the advanced position of the second mobile contact.

7. The circuit breaker apparatus according to claim 6, wherein said first pivoting lever is subjected to the action of a return spring bearing on said case, and is provided with an extension which is applied, when said box is fixed to said case, against a bearing surface belonging to an insulating and sliding rake connected to the armature of the electromagnet and passing through said opening.

* * * * *